US006015166A

United States Patent [19]

May

[11] Patent Number: 6,015,166

[45] Date of Patent: Jan. 18, 2000

[54] BOOKMARK

[76] Inventor: Robert M. May, 67 Richland Crescent, Etobicoke, Ontario, Canada, M9C 4C4

[21] Appl. No.: 08/855,753

[22] Filed: Feb. 24, 1997

[51] Int. Cl.[7] ..... B42D 9/00

[52] U.S. Cl. ..... 281/42

[58] Field of Search ..... 281/42, 15.1, 45; 116/234, 237

[56] References Cited

U.S. PATENT DOCUMENTS

| | | | |
|---|---|---|---|
| 284,404 | 9/1883 | Foote . | |
| 399,768 | 3/1889 | Nlehrer . | |
| 512,747 | 1/1894 | Platt . | |
| 893,353 | 7/1908 | McGill . | |
| 992,916 | 5/1911 | Shiver . | |
| 1,008,481 | 11/1911 | Lopes . | |
| 1,150,678 | 8/1915 | Heazlewood . | |
| 1,469,163 | 9/1923 | Mallina . | |
| 2,116,147 | 5/1938 | Haessler . | |
| 2,136,326 | 11/1938 | Spandorfer . | |
| 2,606,042 | 8/1952 | Freber . | |
| 2,609,629 | 9/1952 | Hubbard . | |
| 2,631,560 | 3/1953 | Myers . | |
| 2,717,572 | 9/1955 | Kingman . | |
| 2,778,331 | 1/1957 | Bonilla . | |
| 2,853,043 | 9/1958 | Bitterman et al. . | |
| 3,090,347 | 5/1963 | Harnett, Jr. . | |
| 3,159,137 | 12/1964 | Baldwin . | |
| 3,381,654 | 5/1968 | Hupp et al. . | |
| 4,024,832 | 5/1977 | Machnikowski . | |
| 4,055,874 | 11/1977 | Brown . | |
| 4,335,903 | 6/1982 | Collins . | |
| 4,569,538 | 2/1986 | Kurschner . | |
| 4,706,342 | 11/1987 | Yu . | |
| 4,778,201 | 10/1988 | Kouno et al. | 281/42 |
| 4,793,632 | 12/1988 | Hottman, Jr. . | |
| 4,824,141 | 4/1989 | Lewis et al. | 281/42 |
| 4,838,198 | 6/1989 | Knox . | |
| 4,908,912 | 3/1990 | Grant | 281/42 X |
| 4,928,361 | 5/1990 | Brown . | |
| 4,932,351 | 6/1990 | Capamaggio | 281/42 X |
| 4,934,304 | 6/1990 | Rosen . | |
| 5,095,846 | 3/1992 | Knight . | |
| 5,152,553 | 10/1992 | Domingo | 281/42 |
| 5,165,722 | 11/1992 | Wong . | |
| 5,244,232 | 9/1993 | Dulberger . | |
| 5,286,060 | 2/1994 | Rivera . | |
| 5,375,884 | 12/1994 | Farrington . | |

OTHER PUBLICATIONS

Superb Catalogue 1997 ASI 90230 p. 9 items 1487, 1486, 1419, 1418, p. 20 all 10 items, p. 21 all 6 items, p. 22 all 10 items, p. 23 all 3 items, p. 24 all 7 items, p. 25 all 7 items, p. 26 all items, p. 27 all items, p. 28 item 530, p. 29 all 5 items.

Alumaline & Brass Catalogue 1997, 41080, p. 9 all items, p. 10 all items, p. 46 all items.

Photocopy of a catalogue page. Ostensibly fm. Sprague.

Letter from Ronald J. Meister of Zippo Manufacturing Who Sent Me the Above Photocopy.

1 Photocopy Sheet Showing Vertical & Horizontal Rulers for Scaling and: 1 metal clip–on bookmark as manuf. by Seagull Pewter Ltd., Pugwash, N.S. Can, 1 metal clip–on bookmark as manufactured by Lindsay Claire Ltd. Niagara Falls, NY, 1 metal clip–on bookmark as manufactured by Swing Inc. New York, NY, 1 plastic paper–clip bookmark distributed by Hartin International, Northridge, CA.

*Primary Examiner*—Willmon Fridie, Jr.

*Attorney, Agent, or Firm*—Pro Se

[57] ABSTRACT

A bookmark, which by shape and proportion clenches a sheaf of pages of a book, and which is easily resettable, using a sliding motion, during a reading session. The invention is a rigid-planar tool comprising a stabilizer(1), a market (2) and a connector(3). The bookmark is placed on the left side of an open book so that if the reader is at page 100, the stabilizer(1) is placed at page 90 and the marker (2) is placed at page 100. When the reader turns the page, she slides the bookmark so that the marker(2) clears the page margin while the stabilizer (1) remains within the page margins at page 90. The reader then reverses her motion to clench the newly turned page between the marker and the stabilizer. The bookmark is reset and clenching the sheaf of pages 91 to 102.

12 Claims, 7 Drawing Sheets

BOOKMARK

BACKGROUND

1. Field of Invention

This invention relates to an improved shape for bookmarks.

2. Description of Prior Art

In the past bookmarks were manufactured from ribbon, cloth, leather, cardboard, and metals. These have been planar devices, usually made in a rectangular shape. These traditional bookmarks are only suitable for marking the reader's position from one reading session to the next. Hoffman Jr., U.S. Pat. No. 4,793,632, Dec. 27, 1988 has added an automatic feature to the bookmark which records the reader's last page turned but his invention is complicated and costly to manufacture. One clip-on bookmark manufactured by Lindsay Claire of Etobicoke, Ontario, Canada, for one, almost got it right by accident. The problem with this bookmark is that it does not facilitate re-setting the mark after the reader has turned the page because it has the wrong proportions. Whether of metal, wood, cord or fabric previous bookmarks leave the bookmark still imperfect either because they are costly or do not facilitate re-setting during a reading session.

OBJECTS AND ADVANTAGES

The bookmark of this invention enables the reader to re-mark her page as she reads with a simple sliding motion of the bookmark. This is the single most useful aspect of this invention. This bookmark is a planar device made from one piece of sheet material which makes it simple and economical to manufacture. The bookmark of my invention can clench a sheaf of pages due to the arrangement of the elements. This clenching action of my invention provides a more secure placement of the bookmark than is obtained with a simple rectangular bookmark. It is a novel bookmark that will stimulate sales for a manufacturer. It has a lasting appeal and so would be suitable as an advertising device due to its simple design and ease of manufacture. It has large flat areas which are suitable for advertising indica. One area of the invention can be decorated with three-dimensional objects such as pewter attachments. This decoration makes the invention more elegant and increases its appeal for buyers.

DRAWING FIGURES

FIG. 1 Shows my bookmark as an asymmetrical embodiment.

FIG. 2 Shows another embodiment of this bookmark with U shape that is symmetrical.

FIG. 3 Shows my asymmetrical bookmark set in a book and clenching a sheaf of pages.

FIG. 4 Shows the bookmark operation in the set position.

FIG. 5 Shows the bookmark operation in the clear position.

FIG. 6 Shows a ramification of my invention where the bookmark is used to target a finishing point for a reading session.

FIG. 7 Shows another embodiment of my invention which is square in overall shape.

FIG. 8 Shows another embodiment of my invention which is similar to an inverted and flipped, letter L FIG. 9 Shows Prior Art, a simple, planar, rectangular bookmark.

FIG. 10 Shows Prior Art, a clip bookmark, with pewter decoration, manufactured by Lindsay Claire of Etobicoke, Ontario, Canada, for one.

FIG. 11 Shows another embodiment of the invention with a plurality of stabilizers(1) elements.

FIG. 12 Shows another embodiment of this invention with a plurality of marker(2) elements.

FIG. 13 Shows an embodiment of this invention where the stabilizer(1) is more than twice as long as the marker(2).

FIG. 14 Shows another embodiment of my invention where the stabilizer(1) is two and a half times as long as the marker(2).

FIG. 15 Shows this invention in the simplest asymmetrical embodiment with the extent of the elements indicated.

FIG. 16 Shows another embodiment of my invention where the stabilizer(1) is twice as long as the marker(2)

FIG. 17 Shows this invention with a different ramification whereby the reader curls a page under the marker(2).

FIG. 18 Shows another embodiment of my invention where the material of manufacture is wire and is similar to a conventional paper clip but with the inner loop shorter than the paper clip.

FIG. 19 Shows yet another embodiment of this invention where the material of manufacture is wire but the general shape of the invention is rectangular rather than oval or rounded.

FIG. 20 Shows another embodiment of the present invention which is made of wire and which includes an extra loop of material in the connector(3) portion of the bookmark.

FIG. 21 Shows an embodiment of this invention which resembles the asymmetrical embodiment of FIG. 1 and is manufactured from wire.

DRAWING REFERENCE NUMERALS

1—A stabilizer element
2—A marker element
3—A connector element

GENERAL BOOKMARK DESCRIPTION AND TERMINOLOGY DEFINED

FIG. 15 is referred to now in order to understand the terminology used hereafter. The invention is a planar device which has three elements which are rigidly connected. These are a stabilizer(1), a marker(2), and a connector(3). The stabilizer(1) extends into the margin of the pages of a book when the bookmark is clenching a sheaf of pages as a bookmark. The marker(2) is significantly shorter than the stabilizer. The marker must clear the page margin while the stabilizer remains substantially engaged within the pages of the book. The length of each of the stabilizer(1) and the marker(2) is determined when the stabilizer(1) is on one side of a regular piece of paper and the marker(2) is on the obverse side. The length of each is the distance from the page margin to the furthest distance each element projects into the page when the bookmark is clenching a page or sheaf of pages. At this point it should be understood that one skilled in the art can select the exact proportion between the marker and the stabilizer. The preferred proportion would be that the marker is shorter than half the length of the stabilizer. The third element is the connector(3) which is the portion of the bookmark which extends beyond the page margins of the book when the bookmark is used to clench a sheaf of pages in marking the reader's position. The connector(3) element serves as a handle when the bookmark is in use and it should not be so large as to be inconvenient as it protrudes from the page margins of the book when the bookmark is in use as intended. The marker is on the front of a page and the stabilizer on the obverse or back of a page when the bookmark is clenching a page as shown in FIG. 3. In FIG. 15 these elements are delineated. The slot as depicted in FIG. 15 is not essential to the bookmark because the marker element could be permanently attached by the connector so that it overlays the stabilizer. This is not the preferred method of manufacture of the bookmark and is not considered further. The bookmark should be manufactured from a stiff and flexible material such as sheet metal, wire, sheet plastic, stratified-wood, stratified wood and metal, PRESSTEX (™ reg. ACCO Wheeling, Ill.), or wood. This list is not intended to be comprehensive but only suggestive. The invention may also be imprinted with advertising or by imprinting with whimsical artwork to make it more singular. The connector(3) remains beyond the page margin and so it may be decorated with three-dimensional objects such as pewter figures.

The marker(2) is approximately one-half the length of the stabilizers(1) in this embodiment of the bookmark. There are openings between the marker(2) and each of the stabilizers (1) which can admit and clench pages of a book. The marker(2) lies on the front side of the clenched pages and the stabilizers(1) would be on the back side of the clenched pages.

Figure 12:
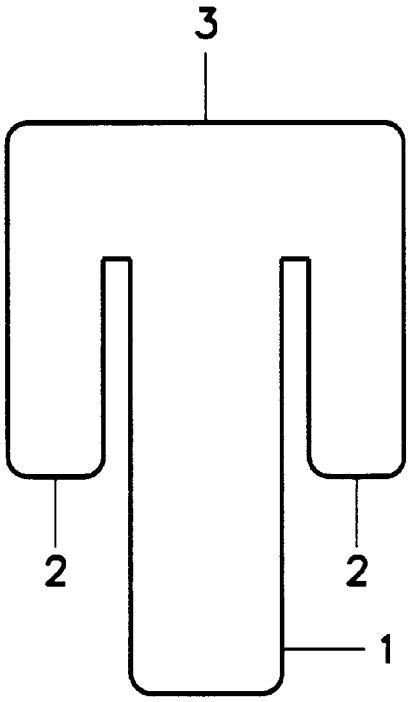

FIG. 12 is another symmetrical embodiment of this invention. The bookmark has the general shape of the letter T with the serifs on the crossbar of the T greatly exaggerated. The crossbar of the T is a connector(3). The upright portion of the T is a stabilizer(1). The serifs on the ends of the crossbar of the T shape hang down and are the markers(2). The connector(3) occupies approximately the top-quarter of this bookmark. The stabillzer(1) is about three-fourths of the overall height of the bookmark. The markers(2) are approximately one-half the height of the stabilizer(1).

Figure 13:
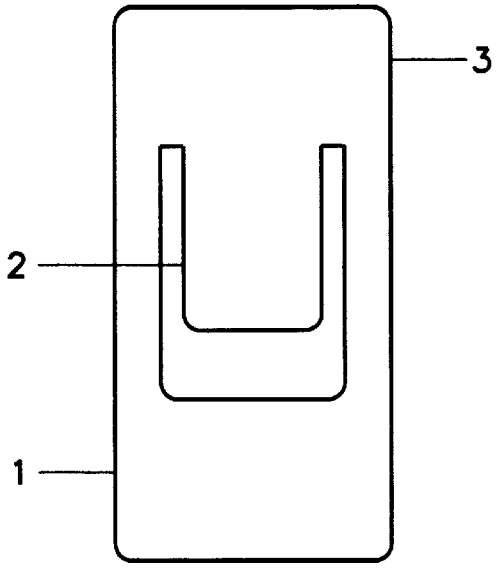

FIG. 13 This is a symmetrical embodiment of this invention which has a rectangular overall shape. A connector(3) lies across the entire top portion of this bookmark. The connector(3) is approximately one-quarter of the total height of the bookmark. A U-shaped stabilizer(1) hangs below the connector(3) from the left and right ends of the connector(3). The base of the U-shape is very high. The length of the stabilizer(1) comprises approximately three-fourths of the height of this bookmark. A marker(2) is cut from the material of the center portion of the letter U. This marker(2) is about five-twelfths of the length of the stabilizer(1). There is an opening between the marker(2) and the stabilizer(1) which can admit a sheaf of pages.

Figure 14:
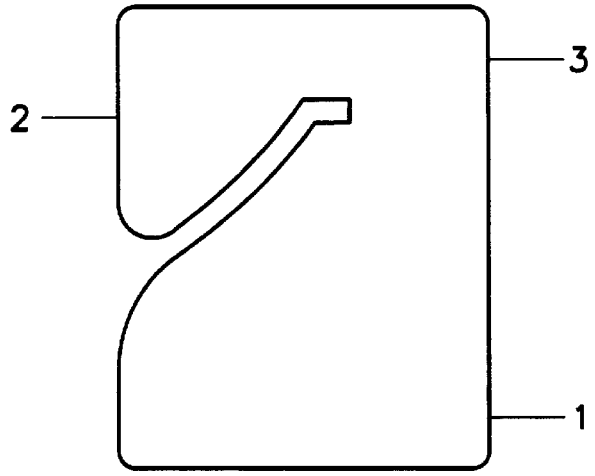
Figure 15:
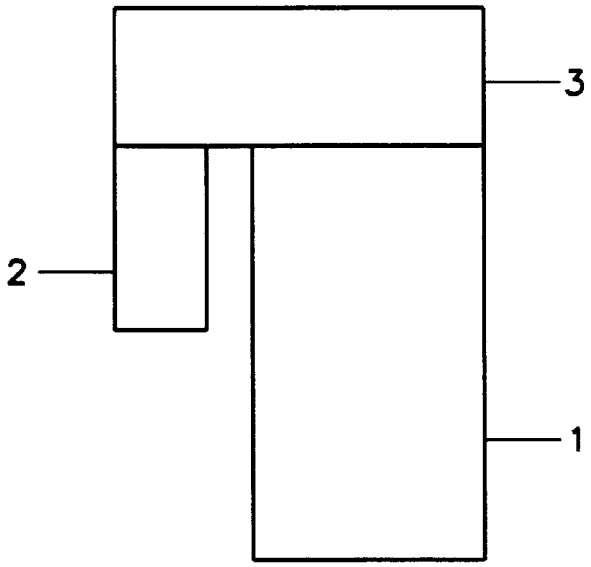

FIG. 14 is an asymmetric embodiment of this invention. The shape of this bookmark is a rectangle which is only slightly higher than it is wide. A connector(3) lies across the entire top portion of this bookmark. A stabilizer(1) hangs down from the connector(3) on one side. A marker(2) hangs down from the connector(3) on the other side. The marker(2) is generally of a triangular shape. The stabilizer(1) lies under the marker(2) so that it forms the largest area of the bookmark. There is a slot between the stabilizer(1) and the marker(2) which provides space for clenched pages. As well this slot continues horizontally between the connector(3) and the stabilizer(1). This horizontal slot portion allows for a greater variation in the thickness of pages that this embodiment can clench.

Figure 16:
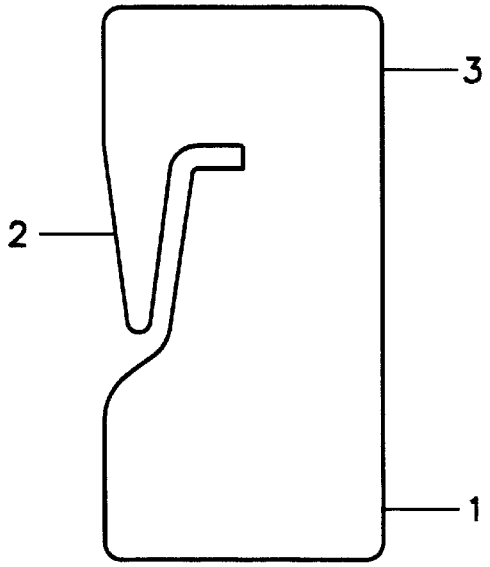

FIG. 16 shows another asymmetrical embodiment of the bookmark invention. This embodiment is a definite rectangle with a height larger than the width. A connector(3) forms the top of the rectangle. The height of the connector(3) is approximately one-quarter of the total height of this bookmark. There is a marker(2) which hangs down from the left end of the connector(3). The marker(2) has the shape of a parabola with the open end at the top. A stabilizer(1) hangs down from the right end of the connector(3). The marker(2) is approximately half as long as the stabilizer(1) in this embodiment of this invention.

Figure 18:
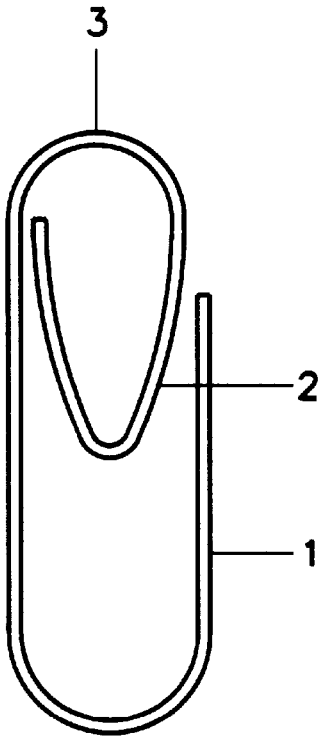

FIG. 18 shows an embodiment of this bookmark which is made from wire. This bookmark is similiar to a paper clip but has an inner loop which forms a marker(2). This marker is substantially shorter than the loop of a regular paper clip. The marker(2) is a parabola which opens upward and the wire joins to a half-circle which forms a connector(3). The connector(3) then joins to a stabilizer(1) which is a parabola opening upward. The stabilizer(1) is approximately twice as long as the marker(2).

Figure 19:
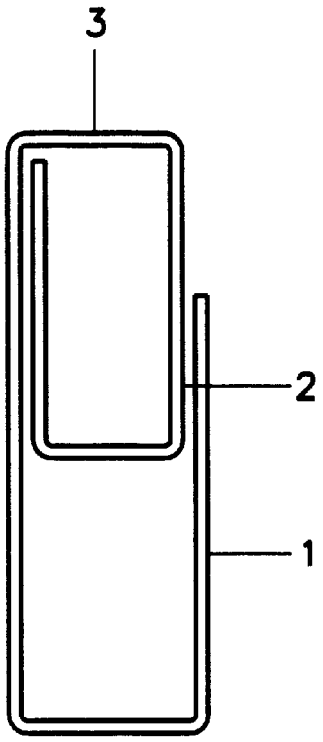

FIG. 19 shows a wire embodiment of this invention which is similar to the paper clip but of a squared-corner configuration. This general appearance is due to the small radius used in making the bends in the wire. The inner loop forms a marker(2) and is connected to a connector(3). The connector(3) is the segment of wire across the top of this bookmark. The connector is joined to a stabilizer(1). The stabilizer(1) is a long-squared-loop. The marker(2) is approximately half as long as the stabilizer(1). In this embodiment a label can be glued around the upper portion of the marker(2) to convert marker(2) into connector(3). Gluing a label around the top portion prevents the marker(2) and stabilizer(1) from being inserted into the page margins. This effectively makes the connector(3) a higher portion of this bookmark.

Figure 20:
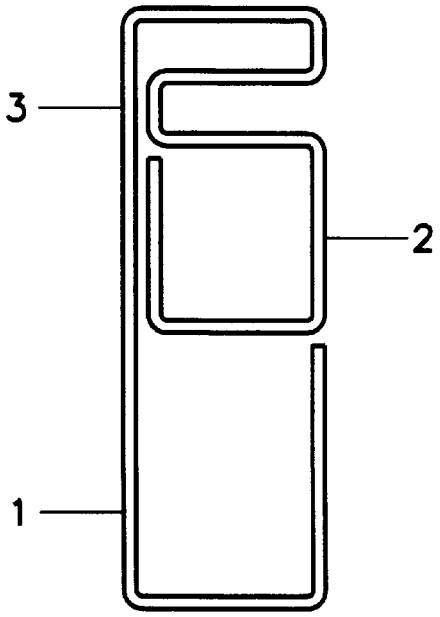

FIG. 20 shows another embodiment of this invention manufactured from wire. This bookmark has a rectangular appearance due to a small radius being us ed to make the bends in the wire to form the bookmark. There is a large loop at the bottom of the bookmark which constitutes the stabilizer(1). The wire continues up to form the connector(3) element of the bookmark at the top end. The connector(3) has an extra loop formed in it to make it higher and provide a larger area to serve as a handle for the user. The wire of the connector(3) joins to yet another loop which is smaller than the stabilizer. This last loop is the marker(2) of this invention. The marker(2) of this embodiment is approximately five-twelfths the length of the stabilizer(1).

Figure 1:
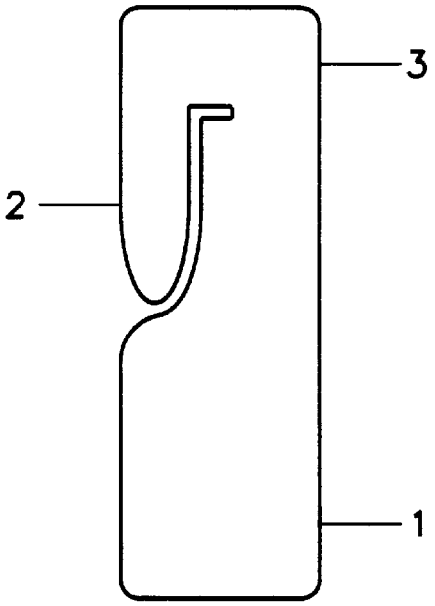
FIG. 1 shows an asym metrical embodiment of a bookmark. The bookmark is generally rectangular in shape. The bookmark is higher than it is wide. A connector(3) lies across the top, one-sixth, portion of the rectangle. The connector(3) connects a stabllizer(l) and a marker(2). The marker has a parabolic shape with the open end at the top where it joins with the connector. There is an opening between the stabilizer(1) and the marker(2) elements. The opening is formed so that it is smooth and regular and generally follows the parabolic shape of the adjacent marker (2) edge. The stabilizer(1) hangs below the connector portion of the bookmark on one side and the marker hangs below the connector on the opposite side. The stabilizer(1) is the largest area of the bookmark. The stabilizer is in effect the remaining portion of the rectangle after the connector(1), the marker(2) and a slot between the marker and connector are accounted for. The stabllizer(1) curves under the marker. The slot between the stabilizer(1) and the marker(2) allows the manufacture from a single piece of rigid-planar material. This slot allows the bookmark to admit the clenched pages. In this embodiment the slot also has a horizontal component between the stabilizer(1) and the connector(3). This horizontal slot allows a greater variation in the number or thickness of the clenched pages that this bookmark can accept between the stabilizer(1) and the marker(2).
Figure 2:
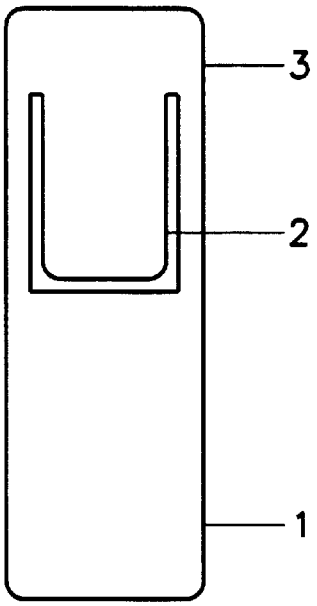
FIG. 2 is an embodiment of a bookmark which is symmetrical about a vertical centerline The vertical centerline is not shown. The bookmark is a rectangle. The height is the long dimension. A connector(3) is the top-one-sixth end of the rectangle. A stabilizer(1) which has a U-shape hangs down from the connector(3). The stabilizer(1) has a very high base segment. A marker(2) hangs down from the middle of the connector(3). The stabilizer(2) is substantially longer than the marker(2). There is a slot between the stabilizer(1) and the marker(2) in this embodiment. This slot provides for a greater thickness of paper to be clenched between the stabilizer(1) and the marker(2).
Figure 3:
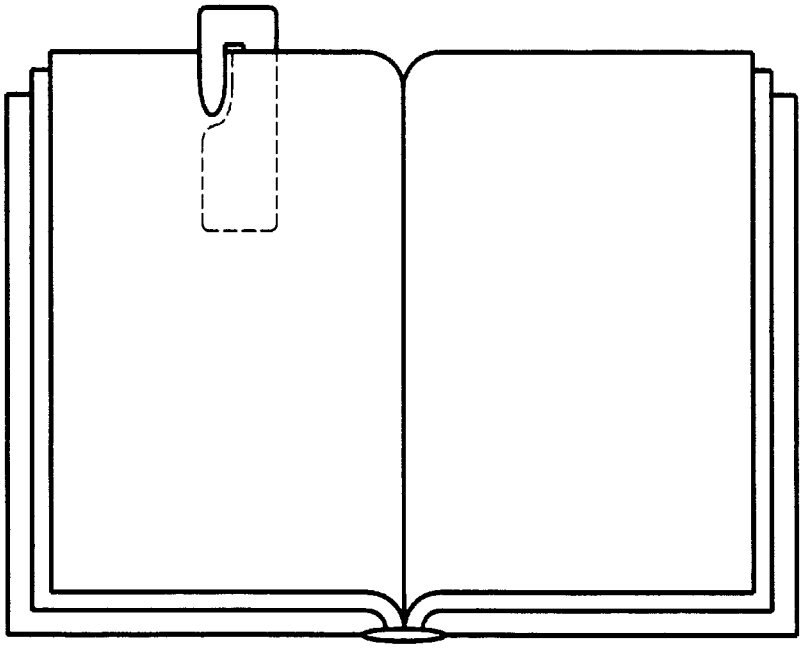
Figure 21:
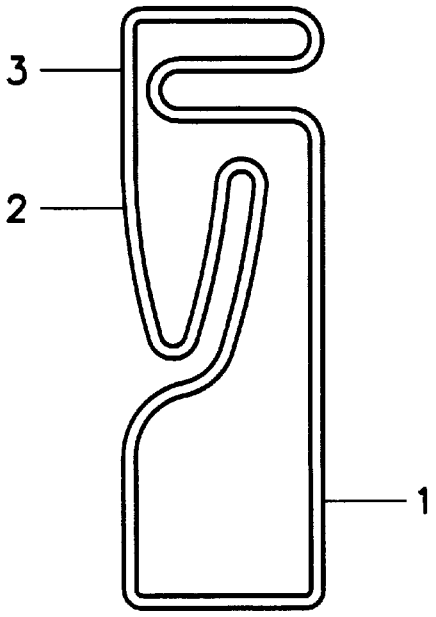

FIG. 21 shows an embodiment of this invention which is manufactured with wire. This embodiment is similar to the form of the asymmetrical bookmark of FIG. 1. A connector (3) is the top portion of this embodiment. The connector(3) has an extra loop formed in it to give it a larger area. The wire from the left side of the connector(3) joins to a marker(2). The marker is formed as a parabola which has the opening up. The marker(2) wire then reverses direction and turns down to begin the stabilizer(1) element of this invention. The stabilizer follows the contour of the marker(2) downward and then outward to the full width of the connector(3). The stabillzer(1) then has a square cornered loop and is finally connected to the right side of the connector(3). The stabilizer(1) is approximately twice as long as the marker(2) in this embodiment.

SUMMARY OF DESCRIPTION

This bookmark has three elements. These elements are a stabilizer(1), a marker(2) and a connector(3). The bookmark of my invention is a planar device manufactured from a stiff and bendable material such as sheet-metal or wire. The bookmark may have a symmetrical or an asymmetrical shape. The shape of each of the elements may be varied but the relationship of the length of the stabilizer(1) and the marker(2) should be higher than two to one. The connector (3) element should have an area large enough so as to be easily grasped between thumb and forefinger but not so large as to be inconvenient when it projects from the page-marked book. The connector lies outside of the page margins of a book when this invention is in use as intended and so may be decorated with three-dimensional objects. The opening between the stabilizer(1) and the marker(2) allows entrance to the pages clenched by the set bookmark. This opening can be very small or much larger in size and is at the discretion of the maker to decide.

The surfaces of any bookmark should be smooth so that contact with pages of a book will not damage or mark those pages. One skilled in the art of manufacturing bookmarks may devise other suitable shapes for this invention and this specification is not limiting but only suggestive.

BOOKMARK USE

Figure 4:
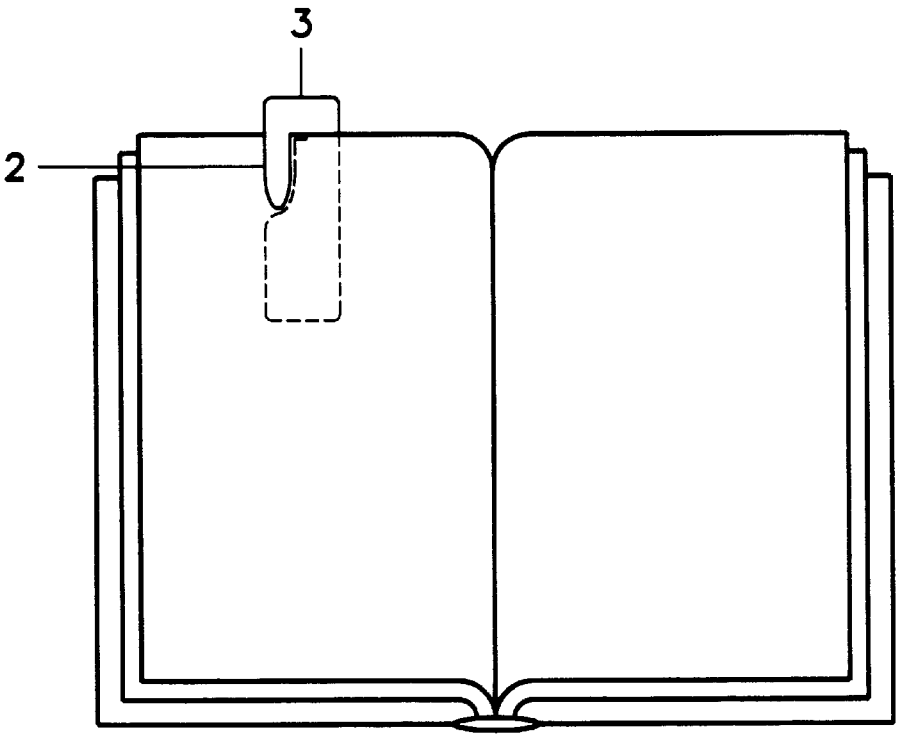
Figure 5:
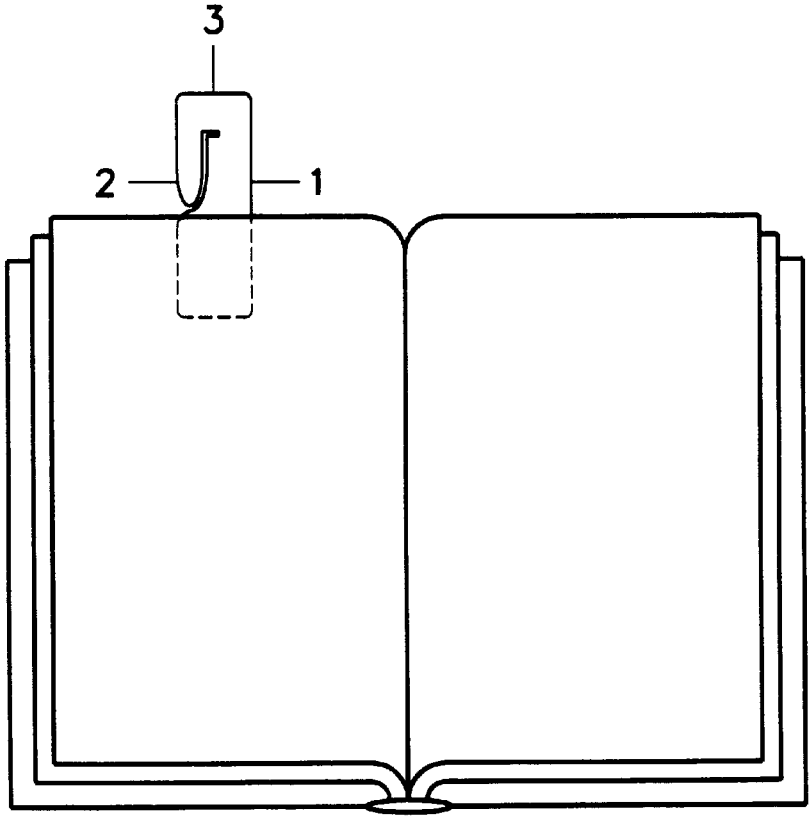

FIG. 4 and FIG. 5 are used here to understand the bookmark use. If the reader is reading on page 100 of a book the book mark is placed so that the stabilizer(1) is some pages behind the reader's position, say at page 90 and on the left-hand side of the open book. The marker(2) is placed at the reader's position and the connector(3) extends beyond the page margins. This is the set position shown in FIG. 4. The stabilizer(1) is on the back of the clenched pages and it appears in hidden lines in FIG. 4. When the reader turns the page she slides the marker out of the book so that the marker is clear of or beyond the page margin. This is the clear position shown in FIG. 5. The stabilizer(1) remains partially within the page margin of the book. The reader then slides the marker back into the book so that it clenches a sheaf of pages which now includes the newly turned page. This is the most recent set position as shown in FIG. 4. The set position of the invention is shown in FIG. 4. The clear position is shown in FIG. 5.

The asymmetric bookmark can be inserted so that the stabilizer(1) is either closer to the spine of the book than the marker(1) or oppositely, the stabilizer(1) can be closer to the outer edge of the book with the marker(2) closer to the spine. When the marker(2) is further from the book spine than the stabilizer(1) the leverage of the marker(2) on the pages predisposes the pages to open to the marker(2) page rather than the stabilizer(1) page.

When the bookmark is used at the side of the page, which is opposite the spine of the book it is deemed to be not as suitable. However, the writer has found that a symetric-wire embodiment is useful with paperback books to hold the pages open when hands-free reading is employed. I haven't documented this further as to do so would delay applying for a patent.

When the bookmark is used at the bottom of the book, the edge closest to the reader, it may be as suitable as when it is on the top of the book as shown in the figures.

The symmetric booksmarks are used in a similar manner to the asymmetric use described above.

Figure 6:
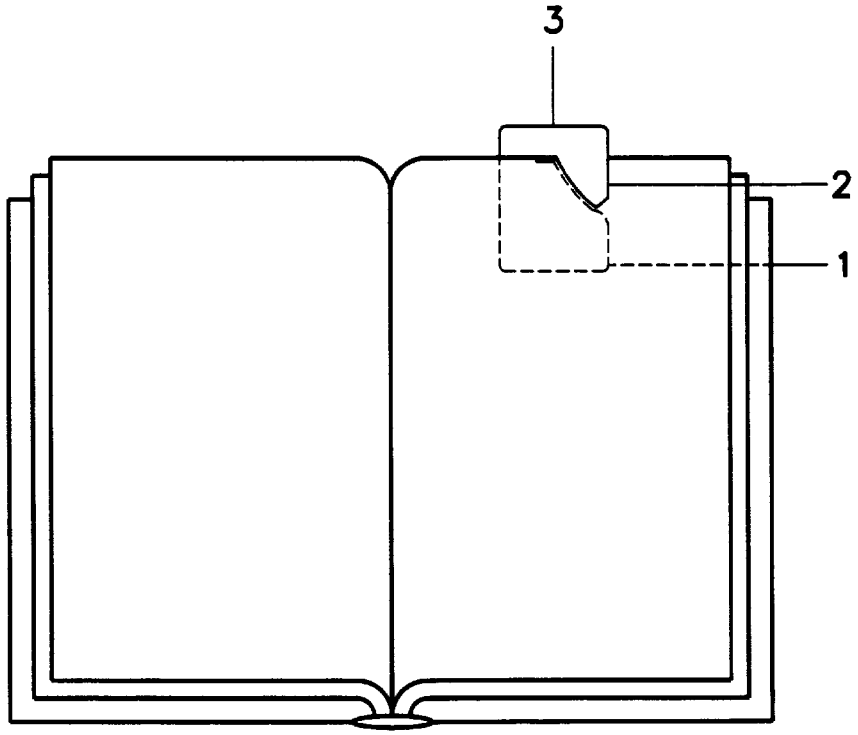
Figure 7:
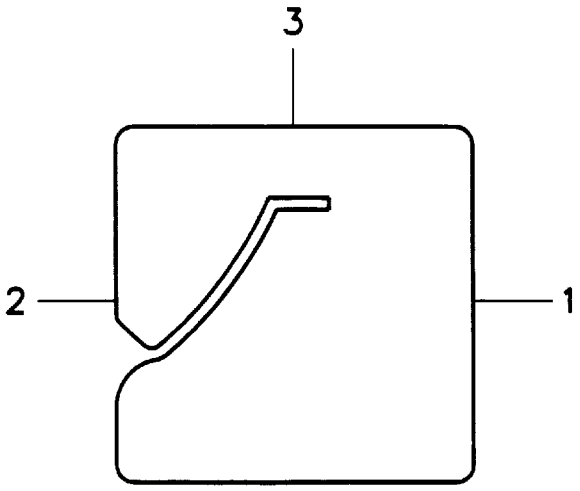
FIG. 7 shows an embodiment of a bookmark which is manufactured with a substantially square shape. This embodiment is asymmetrical. A connector(3) is across the entire top portion of the bookmark. The connector is approximately one-fifth of the height of the bookmark. The stabilizer(c) hangs down from one side of the connector. The marker(2) hangs down from the other side of the connector (3). There is a slot between the stabilizer(1) and the marker (2) which accepts the clenched pages of the book to be marked. The slot has a horizontal component which allows for greater variation in the thickness of the sheaf of clenched pages. The horizontal portion of the slot is not a critical feature and can be eliminated by widening the slot between the marker and the connector. The slot is formed by the edge of the stabilizer(1) and the marker(2). The slot is curvilinear, and in a direction up and to the right.
Figure 8:
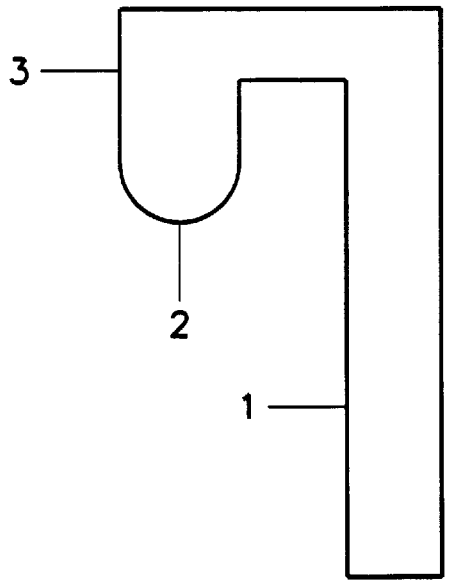
FIG. 8 is another embodiment of the invention which has the general shape of an inverted-letter L. The L is also flipped about the vertical axis. The connector(3) is the element across the top of the bookmark. The connector (3) would be analogous to the horizontal portion of the letter L. The connector(3) of this embodiment is approximately one-eighth of the total height of the bookmark. The stabilizer(3) hangs below the connector on the right side and would be analogous to the upright portion of the inverted and horizontally-flipped letter L. The stabilizer(1) is about seven-eighths of the total height of this bookmark. The marker(2) which is substantially shorter than the stabilizer (1) hangs down from the connector on the left side. The marker(2) is approximately one-quarter of the total height of the bookmark. The large space between the stabilizer(1) and the connector(2) in this embodiment provides less clenching action than other embodiments. This embodiment is more suitable for display purposes as a marker in a book such as an honor roll which is kept on public display and which has a page turned each day.
Figure 9:
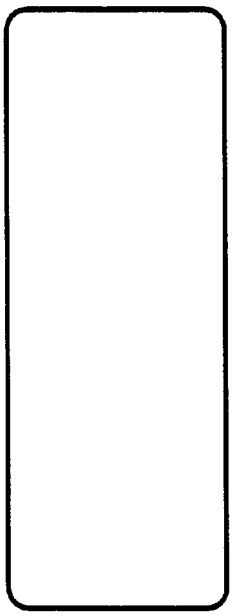
Prior Art Fig. 9
Figure 10:
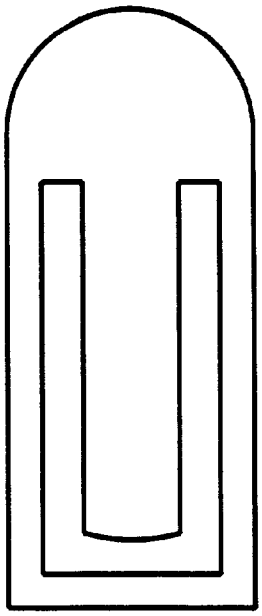
Prior Art Fig. 10
Figure 11:
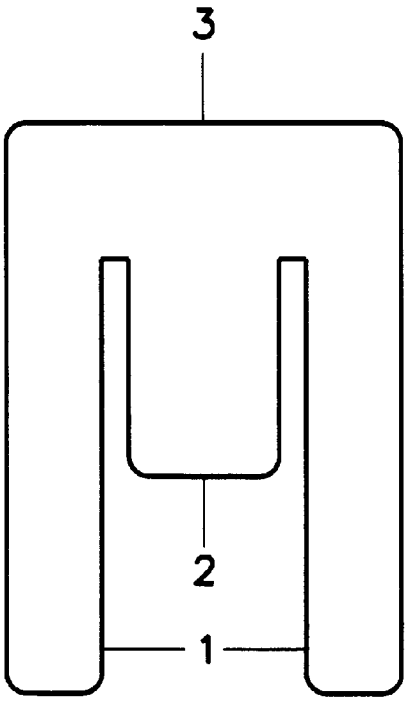
FIG. 11 is a symmetrical bookmark of a less desirable embodiment but is included to help further understand the nature of this invention. A connector(3) extends across the entire top of this bookmark. The connector(3) is about one-quarter of the total height of this bookmark. A marker(2) hangs beneath the connector(3). This marker(2) is about two-fifths of the width of the connector(3) and is centered on the connector(3). Two stabilizers(1) hang down from the connector so that they bracket the marker(2).

FIG. 6 shows an alternate ramification which is described now. This invention is used to target a spot for the reader to complete a reading session. The bookmark is placed so that the stabilizer(1) is some number of pages ahead of the reader's position, say page 110. This would be the target position for completion of a reading session. The marker(2) is placed at the readers actual read page, say page 100. When the reader desires to turn a page, she slips the page out from under the marker(2), then turns the page. The new page is marked by the marker(2) while the stabilizer(1) marks the reader's target page. An alternative use here would be for the reader to slide this bookmark up so that the marker(2) clears the page margin while the stabilizer(1) remains engaged between the page margins of the book. The reader can turn the page and return the bookmark to the set position where the stabilizer(1) and the marker(2) clench a sheaf of pages.

Figure 17:
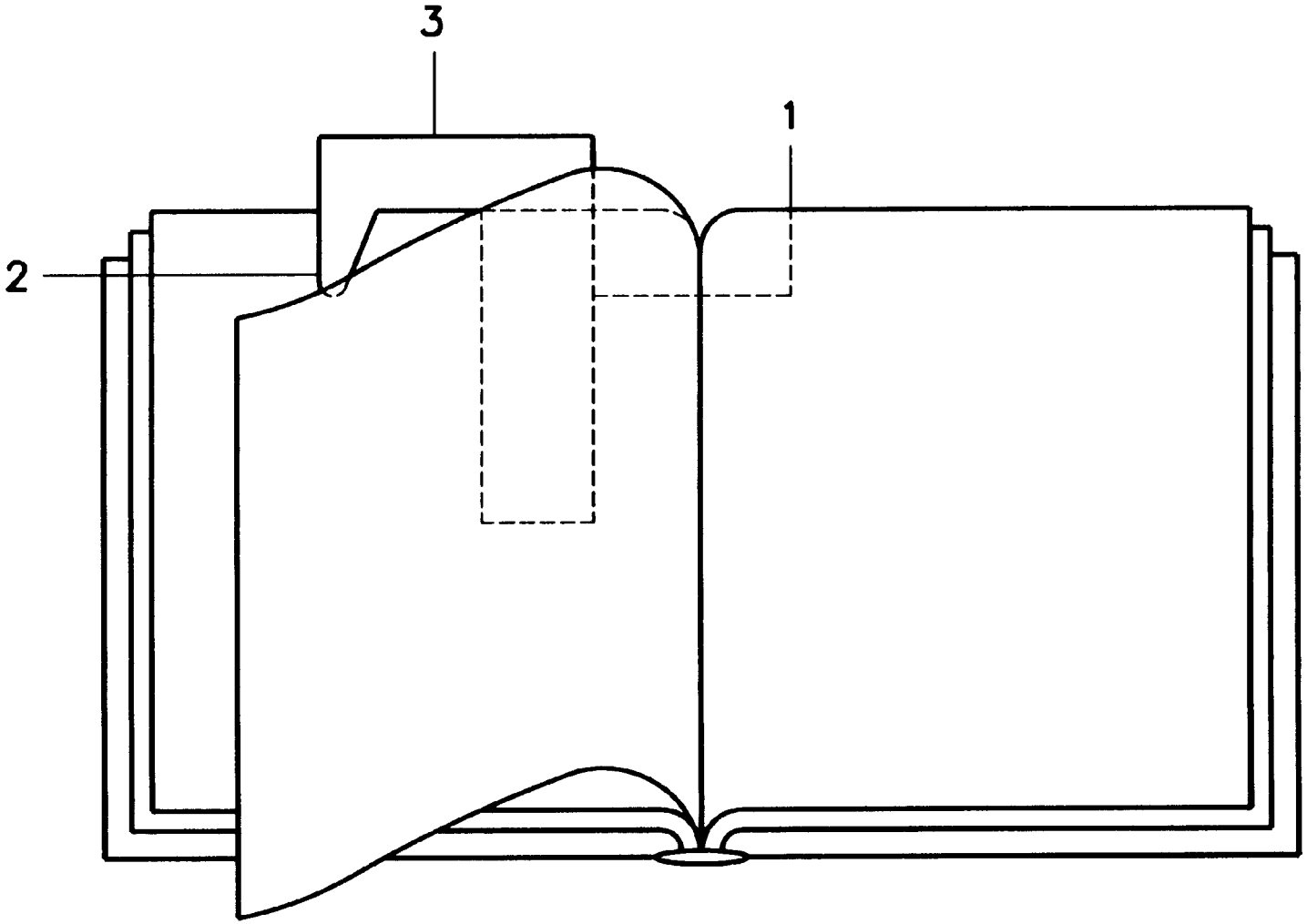

FIG. 17 shows an a symmetric bookmark which is more suitable for display purposes. This ramification of my invention would be used to mark a page as in an honor roll which is on public display. When a new page is selected, the page is bent under the marker(2) as shown in the diagram of FIG. 17.

The reader may find other usages for the invention as well as the ones enumerated here.

I claim:

1. A bookmark which is asymmetrical and comprises at least three elements:

a. a stabilizer(1)

b. a marker(2)

c. a connector(3)

and where:

said stabilizer(1) is as long as the distance that said stabilizer(1) can project into the margin of the page of a book, when said stabilizer(1) is on the top of a page and said marker(2) is on the bottom or obverse side of the page, so that said marker and said stabilizer are clenching a page, and said stabilizer(1) is more than one centimeter longer than said marker (2)

And said marker(2) is more than one centimeter long, and the length of said marker(2) is determined by measuring from the edge of a clenched page to the furthest point from the page margin, when said marker(2) is on the top of a page and said stabilizer (1) is on the bottom or obverse side of the page, And said connector(3) always remains beyond the page margin when each of said stabilizer(1) and said marker (2) are positioned on the front and back sides of a page, so that the page is between said stabilizer(1) and said marker(2), and said bookmark is a rigid-planar or semi-rigid-planar object and is the means to mark a page of interest in a book, magazine or manual, to a reader and said bookmark clenches a sheaf of pages by a wedging or flexing action of said elements and the reader may slide said bookmark so that said marker(2) is clear of the page-margin of a book while said stabilizer(1) remains within the page-margin of the book.

2. The bookmark of claim 1 with a plurality of stabilizers (1).

3. The bookmark of claim 1 with a plurality of markers(2).

4. The bookmark of claim 1 with a plurality of stabilizers (1) and markers(2).

5. A bookmark which is symmetrical and comprises at least three elements:

a. a stabilizer(1)

b. a marker(2)

c. a connector(3)

and where:

said stabilizer(1) is as long as the distance that said stabilizer(1) can project into the margin of the page of a book, when said stabilizer(1) is on the top of a page and said marker(2) is on the bottom or obverse side of the page, so that said marker and said stabilizer are clenching a page, and said stabilizer(1) is more than one centimeter longer than said marker (2)

And said marker(2) is more than one centimeter long, and the length of said marker(2) is determined by measuring from the edge of a clenched page to the furthest point from the page margin, when said marker(2) is on the top of a page and said stabilizer (1) is on the bottom or obverse side of the page, And said connector(3) always remains beyond the page margin when each of said stabilizer(1) and said marker(2) are positioned on the front and back sides of a page, so that the page is between said stabilizer (1) and said marker(2), and said bookmark is a rigid-planar or semi-rigid-planar object and is the means to mark a page of interest in a book, magazine or manual, to a reader and said bookmark clenches a sheaf of pages by a wedging or flexing action of said elements and the reader may slide said bookmark so that said marker(2) is clear of the page-margin of a book while said stabilizer(1) remains within the page-margin of the book.

6. The bookmark of claim 5 with a plurality of stabilizers (1).

7. The bookmark of claim 5 with a plurality of markers(2).

8. The bookmark of claim 5 with a plurality of stabilizers (1) and markers(2).

9. A bookmark which is manufactured from wire and and comprises at least three elements:

a. a stabilizer(1)

b. a marker(2)

c. a connector(3)

and where:

said stabilizer(1) is as long as the distance that said stabilizer(1) can project into the margin of the page of a book, when said stabilizer(1) is on the top of a page and said marker(2) is on the bottom or obverse side of the page, whereby said bookmark is clenching the page of a book, and said stabilizer(1) is more than one and one third as long as said marker(2) and said stabilizer(1) is more than one centimeter longer than said marker(2), And said marker(2) is more than one centimeter long, and the length of said marker(2) is determined by measuring from the edge of a clenched page to the furthest point from the page margin, when said marker(2) is on the top of a page and said stabilizer (1) is on the bottom or obverse side of the page, And said connector(3) always remains beyond the page margin when both said stabilizer(1) and said marker (2) are positioned on the front and back sides of a page, and said bookmark is an object manufactured of wire and is in a single plane and is the means to mark a page of interest in a book, magazine or manual, to a reader and said bookmark clenches a sheaf of pages by the flexing action of the said elements and the reader may slide said bookmark so that the marker(2) is clear of the page-margin of a book while the stabilizer(1) remains within the page-margin of the book.

10. The bookmark of claim 1 with a plurality of stabilizers (1).

11. The bookmark of claim 1 with a plurality of markers (2).

12. The bookmark of claim 1 with a plurality of stabilizers (1) and markers(2).

* * * * *